US009637809B2

(12) United States Patent
Lin et al.

(10) Patent No.: US 9,637,809 B2
(45) Date of Patent: May 2, 2017

(54) ZIRCONIUM ALLOYS EXHIBITING REDUCED HYDROGEN ABSORPTION

(75) Inventors: Yang-Pi Lin, Wilmington, NC (US); David W. White, Wilmington, NC (US); Daniel R. Lutz, San Jose, CA (US)

(73) Assignee: GE-Hitachi Nuclear Energy Americas LLC, Wilmington, NC (US)

( * ) Notice: Subject to any disclaimer, the term of this patent is extended or adjusted under 35 U.S.C. 154(b) by 1032 days.

(21) Appl. No.: 12/624,845

(22) Filed: Nov. 24, 2009

(65) Prior Publication Data

US 2011/0123388 A1 May 26, 2011

(51) Int. Cl.
*C22C 16/00* (2006.01)

(52) U.S. Cl.
CPC ..... *C22C 16/00* (2013.01)

(58) Field of Classification Search
CPC ..... C22C 16/00
USPC ..... 148/421
See application file for complete search history.

(56) References Cited

U.S. PATENT DOCUMENTS

| | | | | |
|---|---|---|---|---|
| 3,097,094 A * | 7/1963 | Rubenstein et al. | ..... | 420/422 |
| 4,664,727 A | 5/1987 | Inagaki et al. | | |
| 4,992,240 A | 2/1991 | Komatsu et al. | | |
| 5,211,774 A * | 5/1993 | Garde et al. | ..... | 148/421 |
| 5,245,645 A | 9/1993 | Steinberg | | |
| 5,278,882 A | 1/1994 | Garde et al. | | |
| 5,712,888 A | 1/1998 | Adamson et al. | | |
| 5,887,045 A * | 3/1999 | Mardon et al. | ..... | 376/457 |
| 6,861,030 B2 * | 3/2005 | Shindo | ..... | 420/422 |
| 2003/0062261 A1 | 4/2003 | Shindo | | |

FOREIGN PATENT DOCUMENTS

| | | | | |
|---|---|---|---|---|
| CN | 101195880 A | 6/2008 | | |
| EP | 0 098 996 | 1/1984 | | |
| EP | 1329526 B1 | 7/2003 | | |
| JP | 4104039 B2 | 6/2008 | | |
| WO | 9606956 A1 | 3/1996 | | |
| WO | WO 9606956 A1 * | 3/1996 | ..... | C22C 16/00 |
| WO | WO-02/29125 A1 | 4/2002 | | |
| WO | 2005094504 A2 | 10/2005 | | |

* cited by examiner

*Primary Examiner* — Roy King
*Assistant Examiner* — Janelle Morillo
(74) *Attorney, Agent, or Firm* — Harness, Dickey & Pierce, P.L.C.

(57) ABSTRACT

An alloy according to example embodiments of the present invention may include zirconium, tin, iron, chromium, and nickel, with a majority of the alloy being zirconium. The composition of the alloy may be about 0.85-2.00% tin by weight, about 0.15-0.30% iron by weight, about 0.40-0.75% chromium by weight, and less than 0.01% nickel by weight. The alloy may further include 0.004-0.020% silicon by weight, 0.004-0.020% carbon by weight, and/or 0.05-0.20% oxygen by weight. Accordingly, the alloy exhibits reduced hydrogen absorption and improved corrosion resistance and may be used to form a fuel assembly component.

16 Claims, No Drawings

ZIRCONIUM ALLOYS EXHIBITING REDUCED HYDROGEN ABSORPTION

BACKGROUND

Field

Example embodiments of the present invention relate to alloys for use in boiling water reactors (BWR).

Description of Related Art

Fuel assembly components (e.g., fuel cladding) in boiling water reactors are conventionally formed of zirconium alloys. However, zirconium alloys are subject to hydrogen absorption during in-reactor operation. In particular, hydrogen (H) originates from the reactor water ($H_2O$) coolant and is generated as part of a corrosion reaction between the zirconium alloy and the reactor water coolant. As a result of the corrosion reaction, hydrogen becomes absorbed in the zirconium alloy. Hydrogen absorption generally increases with in-reactor exposure and/or residence time, wherein an increased absorption of hydrogen results in the precipitation of hydrides, which may have detrimental effects on the mechanical properties of the fuel assembly component formed of the zirconium alloy. For instance, the zirconium alloy may lose the requisite amount of ductility and become embrittled. Accordingly, the operational limits of a nuclear power plant may be restricted by the degraded performance of the zirconium alloy.

SUMMARY

An alloy according to example embodiments of the present invention exhibits reduced hydrogen absorption and improved corrosion resistance. The alloy may be used to form a fuel assembly component or other component of a nuclear reactor.

The alloy may include zirconium, tin, iron, chromium, and nickel, with a majority of the alloy being zirconium. Compared to a conventional zirconium alloy, the alloy according to example embodiments has, by weight, a higher concentration of chromium and a lower concentration of nickel. For instance, the concentration of chromium in the alloy may be between about 0.40-0.75% by weight, while the concentration of nickel may be less than about 0.01% by weight.

The concentration of tin in the alloy may be between 0.85-2.00% by weight. The concentration of iron in the alloy may be between about 0.15-0.30% by weight.

The alloy may further include silicon, carbon, and/or oxygen to improve corrosion resistance. The concentration of silicon may be between about 0.004-0.020% by weight. The concentration of carbon may be between about 0.004-0.020% by weight. The concentration of oxygen may be between about 0.05-0.20% by weight.

DETAILED DESCRIPTION

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations of one or more of the associated listed items.

It should be understood that, although the terms first, second, third, etc. may be used herein to describe various elements, components, regions, layers and/or sections, these elements, components, regions, layers, and/or sections should not be limited by these terms. These terms are only used to distinguish one element, component, region, layer, or section from another region, layer, or section. Thus, a first element, component, region, layer, or section discussed below could be termed a second element, component, region, layer, or section without departing from the teachings of example embodiments.

Spatially relative terms (e.g., "beneath," "below," "lower," "above," "upper," and the like) may have been used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if a device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various embodiments only and is not intended to be limiting of example embodiments. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments may have been described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the shapes of regions that may have been illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions that may have been illustrated in the figures are intended to be schematic in nature and their shapes are not intended to illustrate the actual shape of a region of a device and are not intended to limit the scope of example embodiments.

Unless otherwise defined, all terms (including technical and scientific terms) used herein have the same meaning as commonly understood by one of ordinary skill in the art to which example embodiments belong. It should be also understood that terms, including those defined in commonly used dictionaries, should be interpreted as having a meaning that is consistent with their meaning in the context of the relevant art and will not be interpreted in an idealized or overly formal sense unless expressly so defined herein. Furthermore, it should be understood that the concentrations disclosed herein are merely target values. With regard to the composition of an actual alloy, it will be understood that the concentrations of the constituent elements therein will be in the form of average values so as to encompass a reasonable range.

In a nuclear reactor, an alloy according to example embodiments of the present invention exhibits reduced hydrogen absorption and improved corrosion resistance relative to a conventional alloy. An alloy according to an embodiment of the present invention may include zirconium, tin, iron, chromium, and nickel, with a majority of the alloy being zirconium. Compared to a conventional zirconium alloy, the alloy according to example embodiments has, by weight, a higher concentration of chromium and a lower concentration of nickel. For instance, the concentration of chromium in the alloy may be between about 0.40-0.75% by weight, while the concentration of nickel may be less than about 0.01% by weight.

A conventional zirconium alloy experiences increased corrosion when subjected to a relatively high exposure and/or long-term exposure under radiation. In addition to the corrosion and without being bound by theory, the presence of nickel also appears to render a conventional zirconium alloy more susceptible to hydrogen absorption. However, hydrogen absorption may be reduced by nominally eliminating nickel from a zirconium alloy, as in the alloy according to example embodiments. As a result, even if an alloy according to example embodiments were to experience increased corrosion, the alloy may still exhibit reduced hydrogen absorption.

The concentration of tin in the alloy according to example embodiments may be between about 0.85-2.00% by weight. In a non-limiting embodiment, the concentration of tin may be between about 1.20-1.70% by weight. For instance, the concentration of tin may be about 1.30% by weight.

The concentration of iron in the alloy may be between about 0.15-0.30% by weight. In a non-limiting embodiment, the concentration of iron may be about 0.25% by weight.

The concentration of chromium may be between about 0.50-0.65% by weight. For instance, the concentration of chromium may be about 0.50% by weight. As noted above, the concentration of chromium in the alloy according to example embodiments is higher than that of a conventional alloy. Concentration levels of chromium higher than that disclosed herein are possible but may decrease the workability of the alloy. As a result, the intended use of the alloy may be taken into account to determine to appropriate concentration level of chromium therein.

The alloy may also include silicon. In a non-limiting embodiment, the concentration of silicon may be between 0.004-0.020% by weight. For instance, the concentration of silicon may be between 0.006-0.016% by weight.

The alloy may additionally include carbon. In a non-limiting embodiment, the concentration of carbon may be between 0.004-0.020% by weight. For instance, the concentration of carbon may be between 0.006-0.016% by weight.

The alloy may further include oxygen. In a non-limiting embodiment, the concentration of oxygen may be between 0.05-0.20% by weight. It should be understood that the silicon, carbon, and oxygen may be included individually or in combination to improve the corrosion resistance of the alloy. Because hydrogen absorption is the concomitant effect of zirconium alloy corrosion, hydrogen absorption may be further suppressed by improving the corrosion resistance of the alloy.

The alloy may be used to form a fuel assembly component. For instance, the fuel assembly component may be a fuel cladding or a spacer, although example embodiments are not limited thereto. Instead, the alloy may also be used to form other components that may benefit from reduced hydrogen absorption and improved corrosion resistance, whether in a nuclear reactor or other environment.

While a number of example embodiments have been disclosed herein, it should be understood that other variations may be possible. Such variations are not to be regarded as a departure from the spirit and scope of the present disclosure, and all such modifications as would be obvious to one skilled in the art are intended to be included within the scope of the following claims.

The invention claimed is:

1. An alloy exhibiting reduced hydrogen absorption in a nuclear reactor, comprising:

zirconium, tin, iron, chromium, nickel, and silicon, a majority of the alloy being zirconium, a concentration of the chromium being between about 0.40-0.75% by weight, a concentration of the iron being between about 0.15-0.30% by weight, a concentration of the nickel being less than about 0.01% by weight, and a concentration of the silicon being between 0.004-0.006% by weight.

2. The alloy of claim 1, wherein a concentration of the tin is between about 0.85-2.00% by weight.

3. An alloy exhibiting reduced hydrogen absorption in a nuclear reactor, comprising:

zirconium, tin, iron, chromium, nickel, and silicon, a majority of the alloy being zirconium, a concentration of the chromium being between about 0.40-0.75% by weight, a concentration of the tin being between about 1.20-1.70% by weight, a concentration of the nickel being less than about 0.01% by weight, and a concentration of the silicon being between 0.004-0.006% by weight.

4. The alloy of claim 3, wherein the concentration of the tin is about 1.30% by weight.

5. The alloy of claim 1, wherein the concentration of the iron is about 0.25% by weight.

6. The alloy of claim 1, wherein the concentration of the chromium is between about 0.50-0.65% by weight.

7. The alloy of claim 1, wherein a concentration of the tin is between about 1.20-1.70% by weight and a concentration of the iron is between about 0.2-0.3% by weight.

8. The alloy of claim 7, wherein the concentration of the tin is about 1.30% by weight and the concentration of the iron is about 0.25% by weight.

9. An alloy exhibiting reduced hydrogen absorption in a nuclear reactor, comprising:

zirconium, tin, iron, chromium, nickel, silicon, and carbon, a majority of the alloy being zirconium, a concentration of the chromium being between about 0.40-0.75% by weight, a concentration of the nickel being less than about 0.01% by weight, and a concentration of the silicon being between 0.004-0.006% by weight.

10. The alloy of claim 9, wherein the concentration of the carbon is between about 0.004-0.020% by weight.

11. The alloy of claim 10, wherein the concentration of the carbon is between about 0.006-0.016% by weight.

12. An alloy exhibiting reduced hydrogen absorption in a nuclear reactor, comprising:

zirconium, tin, iron, chromium, nickel, silicon, and oxygen, a majority of the alloy being zirconium, a concentration of the chromium being between about 0.40-0.75% by weight, a concentration of the nickel being less than about 0.01% by weight, and a concentration of the silicon being between 0.004-0.006% by weight.

13. The alloy of claim 12, wherein the concentration of the oxygen is between about 0.05-0.20% by weight.

14. The alloy of claim 1, wherein the alloy is in a form a fuel assembly component.

15. The alloy of claim 14, wherein the fuel assembly component is a fuel cladding.

16. The alloy of claim 14, wherein the fuel assembly component is a spacer.

* * * * *